United States Patent [19]

Connor et al.

[11] 4,384,653

[45] May 24, 1983

[54] TIP-OFF CAP AND CLOSURE FOR CONTAINERS

[75] Inventors: John T. Connor; William A. Conard, both of Norristown; David H. Heistand, Pottstown, all of Pa.

[73] Assignee: The West Company, Phoenixville, Pa.

[21] Appl. No.: 320,578

[22] Filed: Nov. 12, 1981

[51] Int. Cl.[3] ..... B65D 41/58

[52] U.S. Cl. ..... 215/253; 215/303

[58] Field of Search ..... 215/253, 303, 324, 325, 215/296, 305

[56] References Cited

U.S. PATENT DOCUMENTS

| | | | |
|---|---|---|---|
| 1,237,761 | 8/1917 | Dwyer | 215/325 |
| 1,711,232 | 4/1929 | Kimmel | 215/324 |
| 2,180,055 | 11/1939 | Hunt | 215/303 |
| 3,465,906 | 9/1969 | Wagner et al. | 215/253 |

*Primary Examiner*—Donald F. Norton

*Attorney, Agent, or Firm*—Eugene E. Renz, Jr.

[57] ABSTRACT

A tip-off cap and closure for a container, for closure thereof, and sealing of the contents therein. The cap includes a narrow elongated exterior top portion, a peripherally enlarged open bottom skirt at the bottom thereof, and a container closure for an access opening, operatively disposed within the skirt and operatively integrated therewith. The integrated cap and closure are conjointly removable from the container, to open the container for access to the liquid therein, by application of a lateral tilting force against the narrow, elongated cap exterior at a position thereof remote from connection of the cap to the container. Removal of the integrated cap and closure seal means from the container is normally effected without breakage of the material forming the container. The cap and closure act as a unit assembly when being removed. The construction is designed to generally assimilate currently known and used glass ampules for medicaments, in configuration and use, and to have a similar opening procedure thereto.

13 Claims, 6 Drawing Figures

TIP-OFF CAP AND CLOSURE FOR CONTAINERS

TECHNICAL FIELD

The invention relates generally to containers, and cap closures therefor. The container can be of a type for containing a serum material, in the nature of a serum vial, and a composite cap therefor to allow the sealed vial to be opened in much the same manner as known all-glass ampules, but with substantial elimination of any glass breakage. The cap design and structure allows for full removal of the cap and container access closure, such as a stopper, from a serum vial, or other container, prior to filling of a syringe from the vial, or other dispensing of material therefrom.

The invention is principally directed to containers, and closures, of small sizes, such as for single dose medications for oral use, serums, liquor bottles, single dose powder products, and other single use products. Larger sizes of containers are contemplated within the invention, appropriate dimensions to be used.

The containers and their composite caps are designed primarily to be non-reusable, inexpensive, security proficient, and safe in operation of removal of the closure and sealing means from the body of the container, in the absence of container breakage.

The invention is primarily directed to the cap structure and coordinated removal action thereof, and a container closure.

BACKGROUND OF THE INVENTION

Numerous types of containers, in combination with closing and sealing caps therefor, have heretofore been devised and used, and some have provided for ease of removal of a closing and sealing cap from the container.

The containers and their caps and closures can be constructed of different materials, and the specific structures differ substantially, as regards the intercoaction of the caps and stopper closure means for access openings for the containers.

Different types of containers, having different types of closures, and adapted to contain small quantities of materials are found in many different specific forms and configurations. The manner in which the containers are opened is of substantial significance, especially with reference to those containers adapted for use in the medical field for containment of medicines, serums or the like. In addition to ease of opening, the structures must minimize container breakage and contamination of the contents of the container during opening.

Known containers and closures have not completely met the requirements and desires of users in various usage fields. Some of the prior constructions have been complicated and expensive in formation and construction. Other constructions have introduced problems of breakage when opening for access to the contents thereof.

Principally, the present invention is directed to a tip-off cap and closure for containers which will premit integral removal of the cap and a closure from medicament vials, or other types of containers, requiring ease of, and safe removal of, the caps from the containers.

The present invention has different and broad areas of use but, principally, the invention is directed to a new type of preferably metal cap which, when sealed to a container in the nature of a serum vial, allows the so-closed and sealed vial to be opened easily, rapidly, and with a substantial guarantee of absence of breakage of the container material. Other obvious uses of the concepts and teachings of the invention will be readily apparent.

While the present invention will be specifically described in preferred constructional forms, the invention, obviously, is not limited as regards function and/or the specifics of the construction. Variations in use, and specifics of constructional details and materials, will be obvious and within the scope of the invention.

As will be noted in the following detailed description, and disclosure of preferred embodiments of the invention, specifically different forms and details are provided on the disclosed embodiments, and variations within the scope of the invention can be effected.

SUMMARY OF THE INVENTION

The present invention is broadly directed to a composite tip-off type cap and closure for operatively closing and sealing an access opening of a container.

The composite includes a sealing stopper member, which is cooperatively engagable with the access opening in a fluid sealing relation therewith, and a cap, to facilitate container opening.

The cap consists of an upper, elongated tubular configuration having an open bottom end. Proximate and above the open bottom end there is peripherally enlarged hollow skirt portion adapted for operative engagement over the stopper of the container, and over and around the access opening thereof. The skirt portion is frictionally and detachably mechanically engaged with, and surrounds, the finish of the container exterior, about the access opening. The skirt portion encloses and positionally maintains the stopper in closing and sealing engagement with the access opening.

The cap and closure are conjointly removable from the container, as a composite or integrated unit, to expose the access opening, by application of a lateral force proximate the upper end of the elongated cap portion structure, with a resultant angular tilting, or tipping, of the cap. This serves to disengage the composite cap structure from the container for access to the contents therein.

Other objects and advantages of the present invention will become readily apparent to those skilled in the art from the following detailed description, wherein there are shown and described preferred embodiments of the invention, simply by way of illustration of currently preferred and contemplated modes for carrying out the invention. As will be realized, the invention is capable of other and specific embodiments, and its several details are capable of modification in various, obvious respects, all without departing from the invention. Accordingly, the drawings and description are to be regarded merely as illustrative in nature, and not as restrictive.

BRIEF DESCRIPTION OF THE DRAWINGS

The accompanying drawings illustrate preferred embodiments of the invention and, when taken together with the description, serve to explain the principles and structure of the invention.

In the drawings.

RELATED CASES

Figure 1:
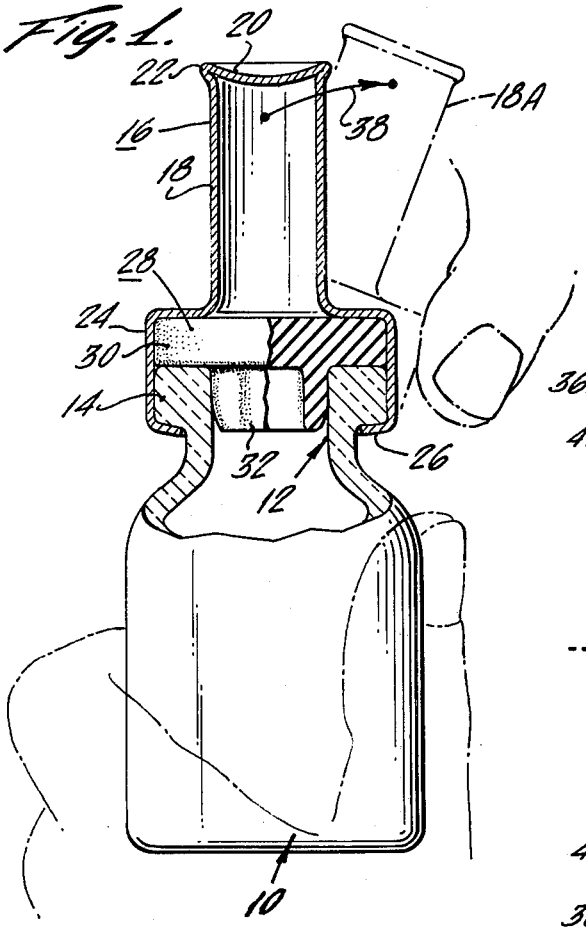
FIG. 1 is an elevational, partial pictorial view, of an embodiment of the invention, and schematically showing a user's hand and disclosing in broken lines a partially detached position of a composite cap and sealing means for the container, the closing and sealing condition being shown in full lines, and parts being broken away and in section, for disclosure of details.

The present invention is related to the invention disclosed in copending application, Ser. No. 06/276,974 in the name of L. David Leiter, entitled COMPOSITE TIP-OFF CONTAINER, filed June 24, 1981 and assigned to a common assignee herewith.

DETAILED DESCRIPTION OF PREFERRED EMBODIMENTS

The invention, and the principles thereof, are shown in the drawings and will be described with respect to incorporation or combination with a typical glass serum vial. This container, or vial, is designated generally at 10 in FIG. 1. The container, or vial, has the usual access opening where indicated by arrow 12 at its open top or end. In the absence of a stopper or seal over the opening, access to the contents of the container is provided, regardless of the nature of the contents. Peripherally surrounding the access opening is the normal container finish 14, constituted in a known manner by a bead-like configuration.

The composite tip-off cap construction is generally indicated at 16. In the embodiment shown in FIG. 1, the cap is preferably of an all metal exterior construction such as aluminum and drawn to shape and, as shown, includes an upper, tubular elongated portion 18. The top is upset at 20 and forms a ridge 22 for strength and a gripping edge. Integrally formed with this tubular upper portion is a lower, peripherally enlarged, outer hollow skirt portion 24. The lower peripheral edge of the skirt portion 24 is adapted to be crimped around and under the lower surface of finish 14, as generally indicated at 26.

A typical type rubber stopper, or the like, 28 is inserted and contained within the lower skirt portion and includes an enlarged head at 30 of commensurate exterior dimensions with the interior dimensions of the skirt portion 24. The bottom 32 of the stopper is of a size to snugly and sealingly engage within the access opening 12 of container 10.

The composite tip-off cap construction shown in FIG. 1 is formed, prior to connection with the container 10, by inserting the head within the peripheral skirt, and operatively integrating the material of the stopper, or a similar means by crimping the lower peripheral edge of skirt 24 around and under the head 30 and finish 14 at the position generally indicated at 34.

Normally, in practice, the metal cap can be shipped to the ultimate under without a stopper. The user will fill the container, seal it with a loose stopper, and crimp the skirt of the cap to adhere the cap in the position shown in FIG. 1.

In the embodiment shown in FIG. 1, the upper or exterior cap portion is preferably all metal, such as aluminum, although other suitable materials can be utilized and different details of interconnection with sealing or stopper means are contemplated. A typical crimp, formed at 26, effectively interengages the various components of the tip-off cap with the container 10. The finalized, or finished, construction is shown in full lines in FIG. 1.

In phantom, or broken, lines 18A in FIG. 1, is disclosed how the tip-off cap is pried off laterally by the hands of the user. This is accomplished generally by application of a lateral pressure, or force, against an upper area, or position of, the elongated cap portion 18 while gripping the container in the other hand. In essence, this removal is the same as utilized for the top or removable portion of a glass ampule, which is broken off by the force applied thereagainst. The cap's length serves as a moment arm or lever during removal.

Figure 3:
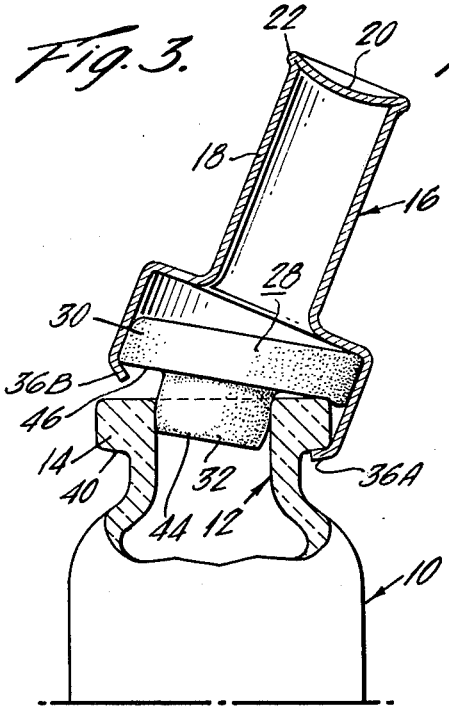
FIG. 3 is a view with removal in a stage succeeding the step of FIG. 2.

Removal of the composite cap, as indicated by the broken lines 18A, is accomplished by an uncurling action of parts of the crimped lower edge of the skirt portion (FIG. 3). The uncurling occurs during opening of the vial by force of the user's hands, multiplied by the mechanical advantage, or leverage, obtained due to the elongated upper tubular cap portion 18 in an obvious manner. Since the portion 18 and the stopper 28 are mechanically integrated as by the crimping, as the tip-off cap is removed, the stopper is also removed with the lower, or plug, portion being retracted from the access opening and the tip-off cap is removed as a single, composite unit. A slight distortion of the crimped portion will take place (FIG. 4), during removal.

Obviously, with this construction, there is no likelihood of breakage of a typical glass serum vial, or one of other similar material. In essence therefore, the tip-off composite cap and closure means of the invention serves its normal function of closing and sealing a container, such as a frangible glass serum vial, and yet permits easy opening of the vial in a usual manner, by application of a force by a user's hands. The structure allows for the full removal of the cap and stopper from the vial to provide access to the contents of the vial. The possibility of glass or other material breakage, during this opening, is obviated, eliminating risk of cut fingers and/or glass particulate in the drug, with substantial pharmaceutical advantages. The design and functioning of the disclosed and described tip-off cap are quite simple. It is also to be noted that this construction opens just like the known glass ampules, primarily due to the tall, or elongated, upper section of the cap. The exterior cap portion can, of course, be manufactured in well known processes, and with known machinery. The stopper is of a known and used type.

Figure 6:
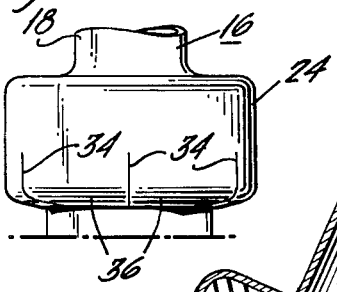
FIG. 6 is a fragmentary elevational view of the skirt portion of the cap disclosing a plurality of score lines which play a significant role in the removal function of the invention.

FIG. 6 of the drawings shows, enlarged, the peripheral skirt corresponding to the lower skirt portion in FIG. 1, and a plurality of controlled scores 34, partially through the material, are provided in the lower edge of the skirt. These scores provide for ease of removal of the cap by lowering the tip-off force required laterally against the upper cap portion, and additionally, as will be explained hereinafter, serve to remove the stopper from the access opening of the container simultaneously with cap removal.

As mentioned above, the cap preferably consists of a metal material and the provision of the score lines serve to, in the crimping action, as described, about the finish 14, to form a plurality of skirt segments 36. As the cap is tilted in the direction of arrow 38 in FIG. 1, a segment of the skirt, shown at 36A at the right hand side of FIG. 2, will remain under the lower edge 40 of finish 14 due to the strength and thickness of the material used in the cap. This segment, or portion, 36A thereby constitutes in effect a lever arm and/or a pivot point for the cap 18 when being removed. In a preferred form, or embodiment of the invention, the skirt is scored at six peripheral positions to form a plurality of segments or portions 36 around the periphery. The number of score lines, and therefore skirt portions or segments, can and will vary depending upon the thickness and strength of material forming the cap.

Figure 4:
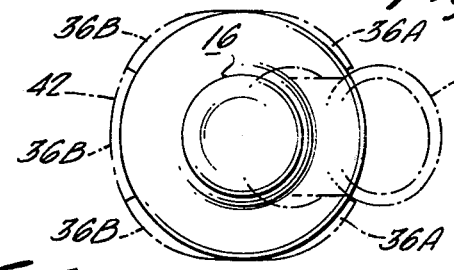
FIG. 4 is a view of the tip-off cap, disclosing a deformation of material during removal.

Referring again to FIG. 2, at the left hand side thereof, a segment designated 36B is shown. As the cap is tilted, as indicated by arrow 18A, there is a distortion in the skirt configuration as shown in FIG. 4. Here the segments 36B have a tendency to be stretched and result in a smaller or more flat curvilinear portion or configuration as indicated generally at 42. When this occurs, the resiliency of the cap forming material in effect provides a finger or plurality of fingers similar to the areas 36B which engage under the outer edge of the stopper head 30, as shown in FIG. 3, and in effect this crimped portion or area of the metal cap picks up and removes the closure seal or stopper from the container during cap removal. In the usual manner the stopper 28 has a plug portion 44, in the embodiment of FIGS. 1, 2 and 3, which is inserted in the access opening neck.

As the cap is moved in the opening direction and the skirt portions 36B, acting as fingers, interengage under the lower edge 46 of head 30 of the stopper, there will be a deformity in the resilient material of the rubber, or like, stopper, as schematically or diagrammatically shown in FIG. 3. In any event, however, the fingers or skirt portions 36B, in engaging the underside of the stopper head at 46 will, by a tilting action, serve to integrate the cap 18 and stopper 28 as a single removal unit or entity in an understandable fashion. The portions of the rim 36A do constitute the fulcrum point in this removal procedure.

As mentioned above, depending upon the thickness and strength of material forming the cap, a greater or lesser number of score lines 34 can be provided to form the plural segments or sectors 36.

Figure 2:
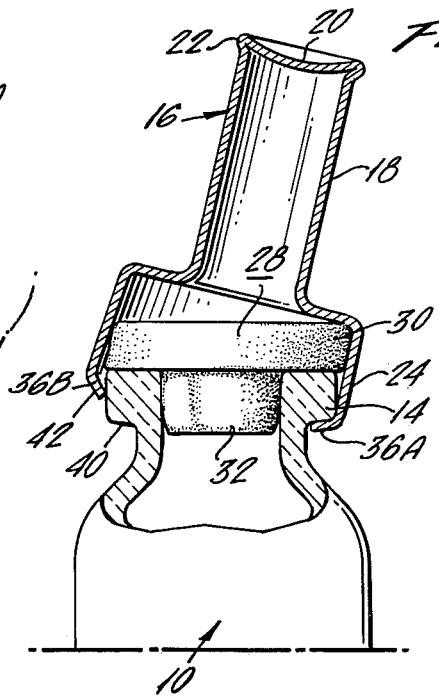
FIG. 2 is a fragmentary view of the tip-off cap and a container closure stopper in the process of removal and showing interaction of portions thereof.

In some instances, the thickness and strength of the material will additionally permit a slight deformation of those portions forming the segments 36A, 36B, but, depending upon the various sizes of the access openings, the plug 44 size, the resiliency of the stopper material and dimensions of the stopper, as also the thickness and strength of the cap material, the integrated removal of the stopper together with the cap sequentially from the positions shown in FIG. 1, FIG. 2 and FIG. 3, wherein the stopper is substantially removed from the access opening, and a slight further motion will completely remove the united or integrated cap and stopper combination 18, 28. While the various dimensions will vary depending upon material used, as an example only, of a workable embodiment, the finish and dimensions of the closures, etc. will have a lip diameter varying, in inches, between 0.510–0.525, a neck interior between 0.270 and 0.285, a height of lip between 0.147–0.162 and an O.D. maximum neck of 0.450. The stopper, which is compatible for use with such dimensions, has a maximum diameter of 0.500 inches, an O.D. plug dimension of 0.300 inches, a depth of plug of 0.159 inches and a head depth of 0.078 inches. The material can be of butyl, rubber or similar materials well known in the art.

The number of scores and their depth will depend upon the material used, and the other dimensions in the finished product. The depth of the scores can also vary depending upon the material thickness used.

It accordingly is believed obvious of the function of removal of the stopper in conjunction with, or conjointly with, the cap in this aforedescribed concept.

Figure 5:
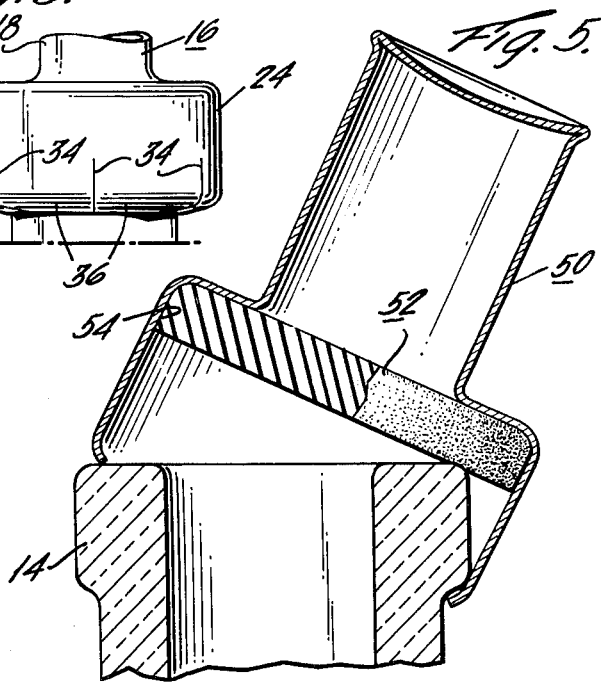
FIG. 5 is a schematic side elevational view of a modified form of the tip-off cap, wherein a disc constitutes a substitute for the stopper of the other shown form.

In FIG. 5 of the drawings, a slightly modified form of the invention is shown. In this embodiment, the cap generally designated 50, is similar to that shown in the previous embodiments. However, in this embodiment, the stopper of the preceeding embodiment has been replaced by a punched or molded disc 52 which has an interference fit against the inside of the metal tip-off cap at the position indicated at 54. This punch or molded disc can be one of many known sealing elements such as press board, rubber, foamed plastic, or other closure lining materials. In operation, as readily seen from a study of FIG. 5, the integrated or unitary removal of the stopper and disc is possible.

It is to be noted, as compared with the above mentioned application assigned to a common assignee herewith, that adhesion or actual fastening of the stopper to the cap is not required. The formation or construction of this type of cap is simple in use, prevents the possibility of contamination due to different types of adhesives used and, otherwise, generally simplifies the overall manufacturing procedure and substantially reduces the cost and workability thereof.

Recapitulating, the present invention is directed to a tip-off type cap in combination with a discrete container opening closure and sealing means. The combination is operatively connected to a container having a neck finish, for sealing and closure thereof, and for conjoint removal to permit access to the contents therein. The cap portion includes a preferably narrow, elongated exterior top portion, and a perpherially enlarged open bottom skirt at the bottom thereof. A container access opening closure and seal means, constituted by an enlarged head and plug type stopper is operatively disposed within the skirt, with the plug portion connected in the container opening and the head portion operatively positioned and contained in the enlarged bottom skirt, with the enlarged head engaging the top of the container body around the opening. The lower edge of the bottom free edge of the enlarged bottom skirt is turned in and crimped about and under the container finish, thereby positively operationally interconnecting the stopper and container. The cap and closure seal stopper are conjointly removable from the container, to open the container for access to the contents therein, by application of a lateral tilting force against the elongated cap exterior at a position thereof remote from the crimped connection of the cap to the container. Removal of the cap and closure seal means from the container is normally effected without breakage of the material forming the container. The cap and closure seal means act as a unit assembly when being removed, with portions of the crimped inturned lower edge constituting hook-like portions resiliently engaging with side and under surfaces of the stopper head upon tilting movement of the cap, with a sufficient operative interengaging force to remove the plug portion from the container opening and so engage the stopper head, for the conjoint removal from the container. The skirt can be provided with scores in order to facilitate, in some instances, a severing of the skirt into hook-like portions, or segments, for engagement with the stopper head. The construction is designed in a preferred form, to generally assimilate currently known and used glass ampules, in configuration and use, and to have a similar opening procedure.

In this disclosure, there are shown and described only preferred embodiments of the invention, but as aforementioned, it is to be understood that the invention is capable of changes and modifications within the scope of the inventive concept as expressed herein.

What is claimed is:

1. A tip-off cap and closure for containers adapted for connection to a container having an access opening, and a neck finish, for closure of the container and sealing of the contents therein, said closure comprising a stopper having a head seatable on the upper surface of said container finish and a plug portion extendind into said access opening, said cap comprising an elongated, narrow exterior top portion, and an open-ended bottom skirt operatively integrated therewith and surrounding said neck finish, said skirt having a free lower end thereon, said skirt being removably attachable to said container about said access opening by crimping said free lower end of said open-ended bottom skirt around said stopper head and around and under said neck finish, said cap and closure stopper being conjointly removable as an integrated unit from a container, to open the container for access to the liquid therein, by application of a lateral tilting force against the elongated cap exterior at a position thereof remote from connection of the cap to the container, said crimped under free lower end of said skirt resiliently operatively engaging under the lower surface of said head upon tilting movement of said cap, and thereby tilting and removing said stopper plug from said access opening and removing said stopper as a unit with said cap by operative engagement with said stopper head.

2. A tip-off cap and closure as claimed in claim 1, said stopper consisting of a resilient material.

3. A tip-off cap and closure as claimed in claim 2, said cap consisting of a drawn aluminum metal.

4. A tip-off cap and closure as claimed in claim 3, said skirt portion having a resilient body thickness sufficient to have said crimped under free lower end, upon tilting of said cap for removal, slide around and up the side of said neck finish and thereafter resiliently engage under portions of the lower surface of said stopper head, skirt portion diametrically opposite the portions gripping the stopper head remaining under said surface finish and constituting a fulcrum for tilting movement of said cap and the said unitized stopper and cap removal.

5. A tip-off cap and closure as claimed in claim 4, said skirt having a plurality of scores therein to facilitate a flexible bending of portions of the skirt upon tilting of said cap and resiliently returning, subsequent to passage over said finish, into engagement under said stopper head.

6. A tip-off type cap and closure means as claimed in claim 5, wherein the bent portions are segregated into separate resilient hook shaped fingers by rupture of the skirt along at least some of said scores, said hook shaped fingers being operatively engagable under said stopper head.

7. A tip-off cap and closure as claimed in claim 5, said scores consisting of a plurality of peripherally spaced scores, the number and positionment of the plural scores being operable to permit stretching of a skirt area portion while retaining substantially unaffected oppositely disposed skirt portions remaining engaged under the surface finish.

8. A tip-off cap and closure as claimed in claim 7, said stopper having a resiliency sufficient to permit disengagement and removal from said access opening while operatively being confined within said skirt of said cap during tilting movement thereof.

9. A tip-off cap and closure as claimed in claim 8, the material of said cap being sufficiently resilient to permit deformation thereof during tilting movement for cap and stopper removal and reengagement with said stopper head subsequent to passage of said edge around said finish.

10. A tip-off cap and closure for containers adapted for connection to a container having an access opening and a neck finish, for closure of the container and sealing of the contents therein, said closure comprising a disc operatively confined within the lower end of said cap and being engageable with and over said access opening, said cap comprising an elongated, exterior top portion, and an open-ended bottom skirt operatively integrated therewith, said disc being seated within said skirt at the juncture position between said top portion and said skirt, said skirt having a free lower end thereon, and surrounding said neck finish, said skirt being removably attachable to a said container about a said access opening by crimping said free lower end of said skirt around said disc and around and under said neck finish, said cap and disc being conjointly removable as an integrated unit from a container, to open the container for access to the liquid therein by application of a lateral tilting force against the elongated cap exterior at a position thereof remote from connection of the cap to the container, said crimped under lower end of said skirt resiliently operatively engaging under the lower surface of said disc upon tilting movement of said cap and tilting thereby and removing said disc and said cap as a unit by operative engagement of said edge with said disc.

11. A tip-off cap and closure as claimed in claim 10, said cap and said disc being discrete entities when positioned on a container but constituting a unitized entity during removal.

12. A tip-off cap and closure as claimed in claim 11, said disc being molded and having an interference fit within said skirt of said cap.

13. A tip-off cap and closure as claimed in claim 12, said molded disc being constituted by a resilient material.

* * * * *